US005215013A

United States Patent [19]

Vrotacoe et al.

[11] Patent Number: 5,215,013

[45] Date of Patent: Jun. 1, 1993

[54] PRINTING BLANKET WITH NOISE ATTENUATION

[75] Inventors: James B. Vrotacoe, Rochester; Charles D. Lyman, Farmington, both of N.H.

[73] Assignee: Heidelberg Harris Inc., Dover, N.H.

[21] Appl. No.: 909,730

[22] Filed: Jul. 7, 1992

[51] Int. Cl.[5] ..... B41F 27/12; B41F 7/22

[52] U.S. Cl. ..... 101/217; 101/375

[58] Field of Search ..... 101/375, 217, 218, 144, 101/216, 219, 212, 376, 415.1, 378; 29/113.1, 113.2, 129.5; 74/1 SS

[56] References Cited

U.S. PATENT DOCUMENTS 650,290 5/1900 Wirt .

4,089,265 5/1978 White et al. ..... 101/375

4,753,363 3/1986 Shin .

4,913,048 4/1990 Tittgemeyer ..... 101/141

*Primary Examiner*—J. Reed Fisher

*Attorney, Agent, or Firm*—Tarolli, Sundheim & Covell

[57] ABSTRACT

A tubular printing blanket (20) has a metal sleeve (42) which is receivable over a blanket cylinder (14) in an offset printing unit (10). The sleeve (42) is expandable diametrically under the influence of pneumatic pressure directed against the inner surface (46) of the sleeve (42), and is movable telescopically over the blanket cylinder (14) when in its expanded condition. The tubular printing blanket (20) has a damping ring (120) for attenuating noise upon expansion of the sleeve (42) under the influence of the pressurized flow of air. The damping ring (120) damps vibrations of the sleeve (42) which are caused by the pressurized flow of air, and which cause noise.

10 Claims, 2 Drawing Sheets

PRINTING BLANKET WITH NOISE ATTENUATION

FIELD OF THE INVENTION

The present relates to an offset printing unit, and particularly relates to a printing blanket for a blanket cylinder in the printing unit.

BACKGROUND OF THE INVENTION

An offset printing unit has a plurality of rotatable cylinders, including a plate cylinder and a blanket cylinder. The plate cylinder carries a printing plate having a surface on which an inked image is defined. The blanket cylinder carries a printing blanket. The plate on the plate cylinder transfers the inked image to the blanket on the blanket cylinder at a nip between the plate cylinder and the blanket cylinder when the cylinders rotate. The blanket on the blanket cylinder subsequently transfers the inked image to the material being printed, such as a web of paper.

A printing blanket is conventionally formed as a sheet, and is mounted on a blanket cylinder by wrapping the sheet around the blanket cylinder. A printing blanket can alternatively be formed as a tube which is mounted on a blanket cylinder by sliding the tube telescopically over the blanket cylinder. Such a tubular blanket has a cylindrical sleeve which supports the blanket in a tubular shape. The sleeve and the blanket cylinder are designed so that the sleeve is receivable over the blanket cylinder with an interference fit. The blanket cylinder is equipped with air flow passages and openings to direct a pressurized flow of air over the blanket cylinder. When the sleeve in the tubular blanket is located over the air flow openings in the blanket cylinder, the pressurized flow of air expands the sleeve diametrically. The expanded sleeve can be moved axially onto, or off of, the blanket cylinder when in its expanded condition. When the pressure is relieved, the sleeve contracts diametrically against the blanket cylinder and thus establishes an interference fit with the blanket cylinder.

SUMMARY OF THE INVENTION

In accordance with the present invention, a printing blanket for an offset printing unit has a tubular shape, and is receivable telescopically over a blanket cylinder which has air flow openings for directing a pressurized flow of air over the blanket cylinder. The tubular blanket has a cylindrical printing portion with a cylindrical outer printing surface. The tubular blanket also has a cylindrical sleeve which supports the cylindrical printing portion. The sleeve has an initial condition and an expanded condition. When the sleeve is in its initial condition, it has an inside diameter which is less than the diameter of the blanket cylinder. When the sleeve is in its expanded condition, it has an inside diameter which is greater than the diameter of the blanket cylinder. The sleeve in the tubular blanket is expandable to its expanded condition under the influence of the pressurized flow of air over the blanket cylinder when the sleeve is located telescopically over the air flow openings in the blanket cylinder.

The tubular blanket further comprises a means for attenuating noise created by the pressurized flow of air acting on the tubular blanket. Preferably, the noise attenuating means damps vibrations of the sleeve which are caused by the pressurized flow of air acting on the sleeve.

In a preferred embodiment of the invention, the sleeve has an end portion which extends axially beyond the end of the blanket cylinder, and the noise attenuating means comprises a damping ring extending circumferentially around the inside of the end portion of the sleeve. The damping ring is a thin strip of noise damping material which is adhered permanently to the inside surface of the sleeve. When the pressurized flow of air acts on the sleeve to expand the sleeve diametrically, the damping ring minimizes the vibrations of the sleeve which are caused by the pressurized flow of air, and thus minimizes the level of noise which must be tolerated by personnel working with the printing unit.

BRIEF DESCRIPTION OF THE DRAWINGS

The foregoing and other features of the present invention will become apparent to those skilled in the art upon a consideration of the following description of the invention with reference to the accompanying drawings, wherein.

DESCRIPTION OF A PREFERRED EMBODIMENT

Figure 1:
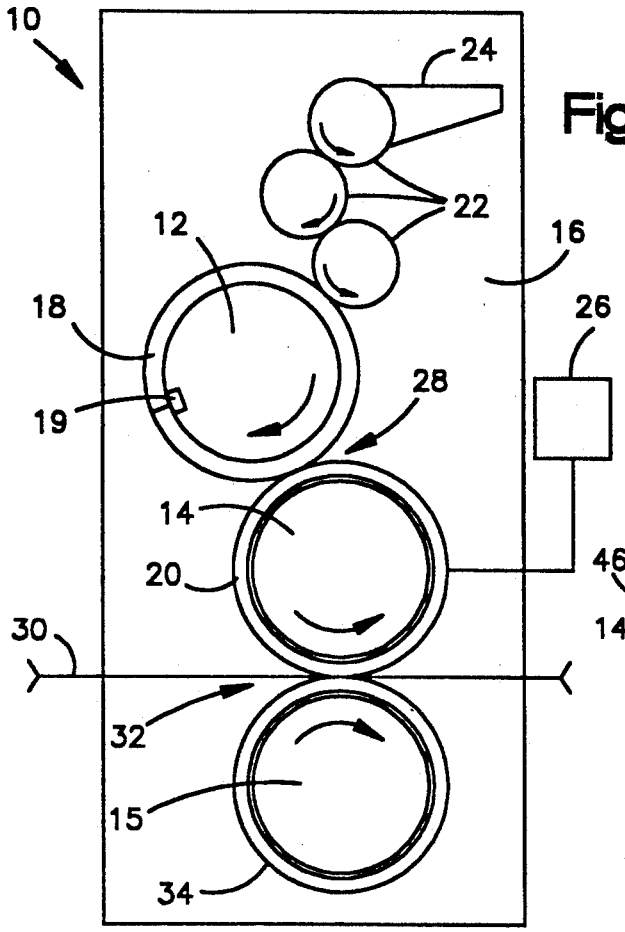
FIG. 1 is a schematic view of a printing unit constructed in accordance with the present invention.

A printing unit 10 constructed in accordance with the present invention is shown schematically in FIG. 1. The printing unit 10, by way of example, is an offset lithographic printing unit including a plate cylinder 12, a blanket cylinder 14 and an impression cylinder 15. The plate cylinder 12, the blanket cylinder 14 and the impression cylinder 15 are supported for rotation at their opposite ends in a pair of side frames 16, one of which is shown in FIG. 1.

The plate cylinder 12 carries a printing plate 18 which defines an image to be printed. The printing plate 18 is formed as a thin metal sheet, and is mounted on the plate cylinder 12 by wrapping the sheet around the plate cylinder 12. A locking mechanism 19 in the plate cylinder 12 holds the printing plate 18 securely on the plate cylinder 12. The blanket cylinder 14 carries a printing blanket 20. The blanket 20 is formed as a tube which is mounted on the blanket cylinder 14 by sliding the tube telescopically over the blanket cylinder 14.

The printing unit 10 also includes inker rolls 22, an ink fountain 24 and a motor 26. The motor 26 drives a gear train (not shown) which is connected to the cylinders and rolls in the printing unit 10 to rotate the cylinders and rolls as indicated by the arrows shown in FIG. 1. The motor 26 and the gear train can be constructed as known in the art.

When the cylinders and rolls are being rotated by the motor 26 and the gear train, the inker rolls 22 transfer ink from the ink fountain 24 to the printing plate 18 on the plate cylinder 12. The printing plate 18 transfers the inked image to the blanket 20 on the blanket cylinder 14 at the nip 28 between the plate cylinder 12 and the blanket cylinder 14. The blanket 20 subsequently transfers the inked image to the material being printed, which is preferably a web 30 moving through the nip 32 between the blanket cylinder 14 and the impression cylinder 15. As shown in FIG. 1, the impression cylinder 15 is a second blanket cylinder carrying a second tubular printing blanket 34 for printing simultaneously on the opposite side of the web 30.

Figure 3:
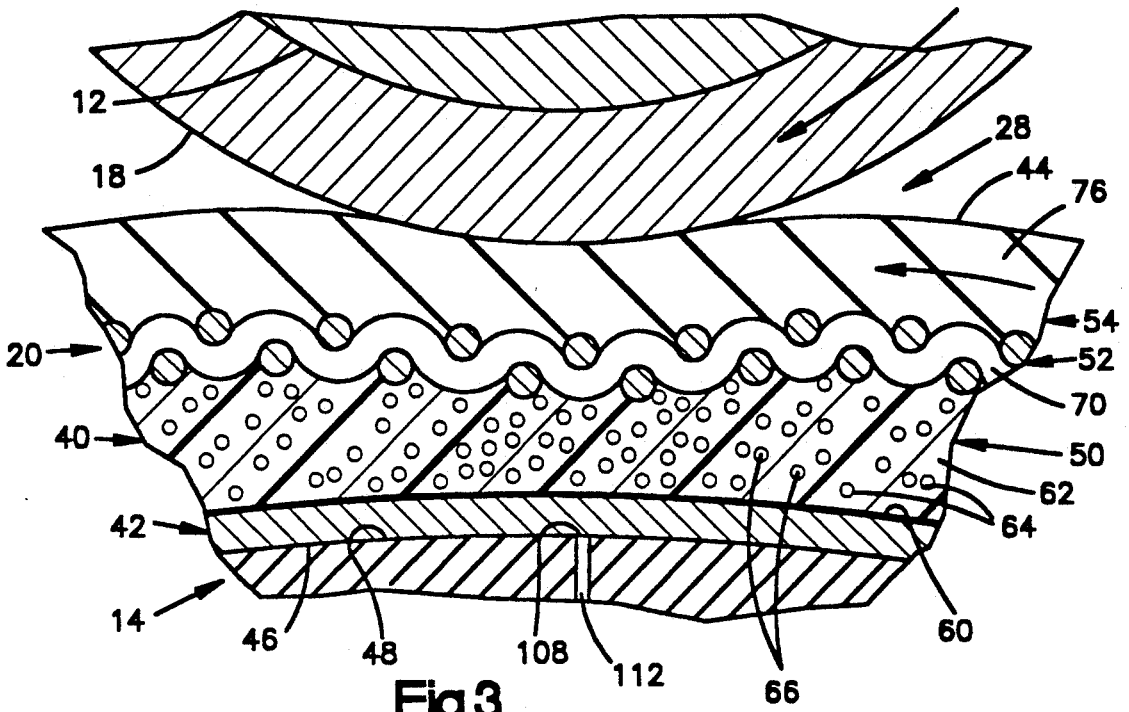
FIG. 3 is a partial sectional view of parts shown in FIG. 1.

As shown partially in FIG. 3, the blanket 20 has a printing portion 40 and a supporting sleeve 42. The printing portion 40 is flexible, and has a cylindrical shape with a gapless cylindrical outer printing surface 44. The sleeve 42 is relatively rigid, and has a gapless cylindrical inner surface 46. The inner surface 46 of the sleeve 42 extends circumferentially entirely around the cylindrical outer surface 48 of the blanket cylinder 14. In the preferred embodiment of the invention, the sleeve 42 is made of nickel.

As further shown in FIG. 3, the printing portion 40 of the blanket 20 is formed in layers. In the preferred embodiment of the invention shown in the drawing, the printing portion 40 includes layers similar to the layers of the printing blanket shown in U.S. Pat. No. 3,700,541 to Shrimpton et al. The printing portion 40 thus includes a compressible layer 50, a strengthening layer 52 and a printing layer 54.

The compressible layer 50 in the printing portion 40 of the blanket 20 is fixed to the sleeve 42 by an adhesive bond 60, and comprises a body 62 of elastomeric material. The body 62 of elastomeric material has uniformly distributed microcells 64 which impart compressibility to the body 62. The microcells 64 are produced by the incorporation of compressible hollow microspheres 66 in the elastomeric material of the body 62. The body 62 of elastomeric material could also be rendered compressible by the incorporation of material other than the microspheres 66, such as pieces of compressible thread as shown in U.S. Pat. No. 3,887,750 to Duckett et al. Alternatively, the body 62 could be rendered compressible by known methods of producing empty voids, such as by blowing and leaching as shown in U.S. Pat. No. 4,025,685 to Haran et al.

The strengthening layer 52 in the printing portion 40 of the blanket 20 is formed of a fabric 70 bonded with a polymer composition. The printing layer 54 is formed of a body 72 of elastomeric material, and defines the outer printing surface 44 of the blanket 20. Unlike the printing layer shown in the patent to Shrimpton et al., the printing layer 54 is cylindrical, and the outer printing surface 44 is a continuous, gapless cylindrical surface extending circumferentially entirely around the blanket 20.

When the rolls and cylinders in the printing unit 10 rotate under the influence of the motor 26 as shown in FIG. 1, the printing plate 18 on the plate cylinder 12 moves against the blanket 20 on the blanket cylinder 14 at the nip 28 between the plate cylinder 12 and the blanket cylinder 14. As shown in FIG. 3, the blanket 20 is indented where the printing plate 18 presses against it at the nip 28. The compressible layer 50 in the blanket 20 becomes compressed beneath the indented portions of the printing layer 54 and the strengthening layer 52. The compressible layer 50 thus allow radially inward displacement of the printing layer 54 and the strengthening layer 52 so that the printing surface 44 on the printing layer 54 will not bulge radially outward on opposite sides of the nip 28. If the printing surface 44 were to bulge radially outward in addition to being indented radially inward as shown in FIG. 4, such deformation of the printing surface 44 could smear the inked image being transferred from the printing plate 18 to the blanket 20, as is known in the art.

Figure 4:
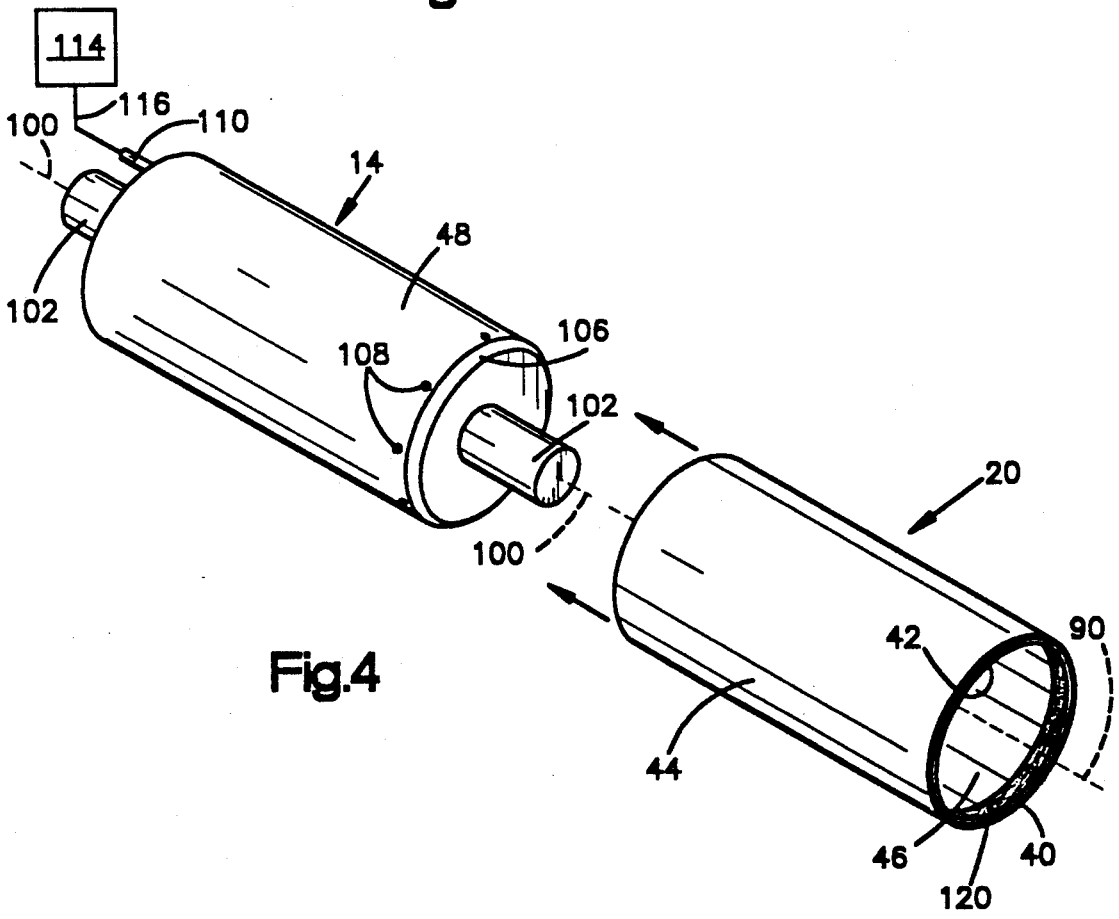
FIG. 4 is a schematic view of parts shown in FIG. 1.

As shown more fully in FIG. 4, the blanket 20 has a central axis 90. Also shown more fully in FIG. 4 is the blanket cylinder 14. The blanket cylinder 14 has a central axis 100, and a pair of stub shafts 102 for supporting the blanket cylinder 14 to rotate about the axis 100 in the printing unit 10. The blanket cylinder 14 also has a chamfered edge surface 106 at one axial end of the cylindrical outer surface 48. The cylindrical outer surface 48 of the blanket cylinder 14 has a diameter which is slightly greater than the inside diameter of the sleeve 42 in the blanket 20. The chamfered edge surface 106 of the blanket cylinder 14 slopes radially inward from the outer surface 48, and has a diameter at its radially inner end which is slightly less than the inside diameter of the sleeve 42.

Figure 2:
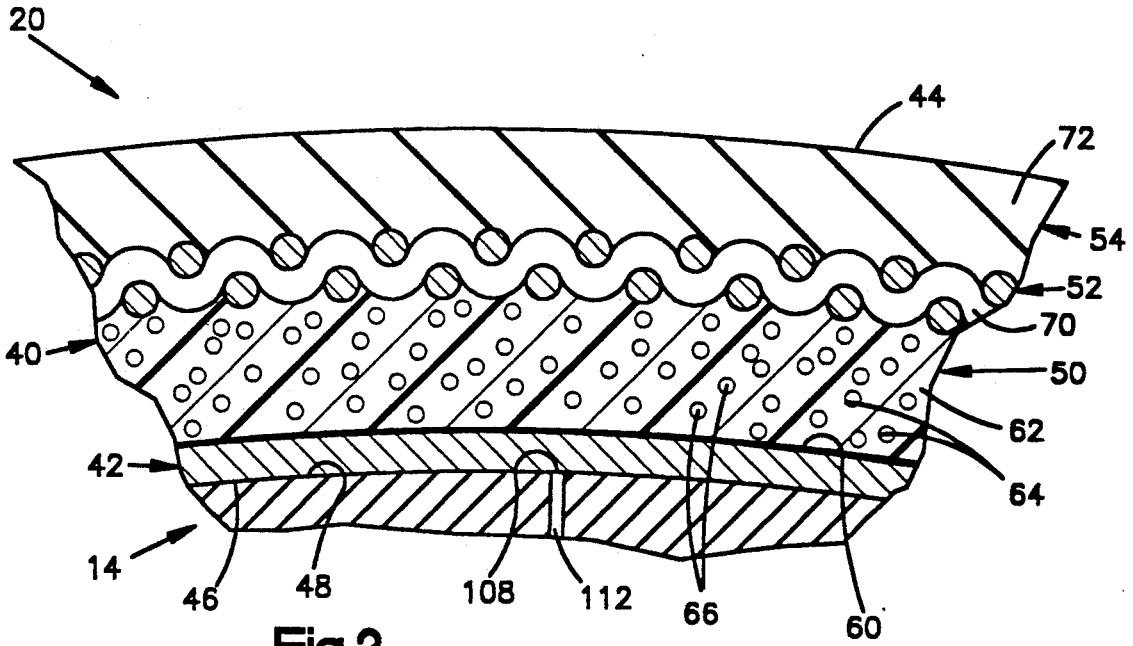
FIG. 2 is a partial sectional view of parts shown in FIG. 1.

The blanket cylinder 14 further has a plurality of air flow openings 108 at the outer surface 48. The air flow openings 108 are arranged in a circumferential array closely spaced from the chamfered edge surface 106, and communicate with an air flow inlet 110 through a plurality of air flow passages 112 (FIGS. 2, 3) within the blanket cylinder 14. The air flow inlet 110 selectively communicates with a source 114 of pneumatic pressure through a pneumatic line 116.

As indicated by the arrows shown in FIG. 4, the blanket 20 is receivable telescopically over the blanket cylinder 14. Because the outer surface 48 of the blanket cylinder 14 has a diameter which is slightly greater than the inside diameter of the sleeve 42 in the blanket 20, the sleeve 42 is forced to expand diametrically when it is moved against the chamfered edge surface 106 in a direction axially toward the cylindrical outer surface 48. When the inner surface 46 of the sleeve 42 is moved axially over the air flow openings 108 at the outer surface 48 of the blanket cylinder 14, pneumatic pressure is directed from the source 114 to the air flow openings 108. Pressurized air then flows radially outward from the openings 108 and impinges against the inner surface 46 of the sleeve 42 to expand the sleeve 42 diametrically.

The pneumatic pressure directed against the inner surface 46 of the sleeve 42 expands the sleeve 42 continuously as the sleeve 42 is moved axially over the outer surface 48 of the blanket cylinder 14. When the blanket 20 is moved axially into its installed position on the blanket cylinder 14, the pneumatic pressure is relieved. The sleeve 42 then elastically contracts diametrically against the outer surface 48 of the blanket cylinder 14. The blanket 20, which has an initial inside diameter less than the diameter of the outer surface 48 of the blanket cylinder 14, is thus installed on the blanket cylinder 14 with an interference fit.

The blanket 20 is subsequently removed from the blanket cylinder 14 by again expanding the sleeve 42 diametrically under the influence of pneumatic pressure, and by sliding the blanket 20 axially off of the blanket cylinder 14 when the blanket 20 is in its expanded condition. The nickel material of the sleeve 42 has the optimum elasticity for installing and removing the blanket 20 in the foregoing manner when subjected to standard shop pressure of 90 psi.

Figure 5:
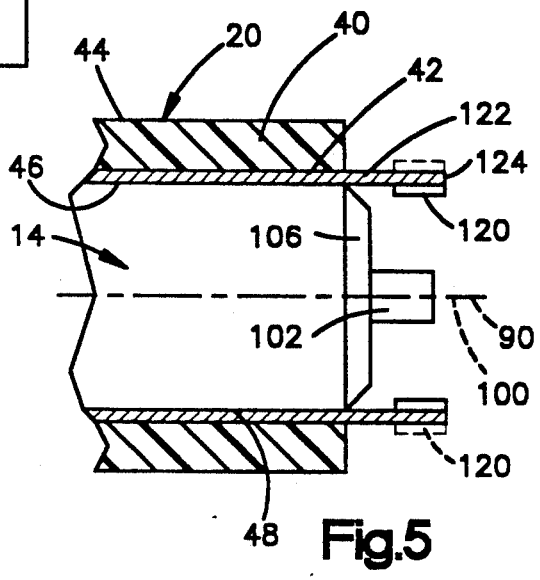
FIG. 5 is a partial sectional view of parts shown in FIG. 4.

When the sleeve 42 in the blanket 20 is expanded over the blanket cylinder 14 as described above, the pressurized flow of air between the outer surface 48 of the blanket cylinder 14 and inner surface 46 of the sleeve 42 causes the sleeve 42 to vibrate. The vibrations of the sleeve 42 in turn cause noise. The blanket 20 therefore includes a means for attenuating noise, which in the preferred embodiment comprises a noise attenuator in the form of a vibration damping ring 120. As shown in FIGS. 4 and 5, the damping ring 120 is mounted on the inner surface 46 of the sleeve 42, and damps vibrations of the sleeve 42 which are caused by the pressurized flow of air between the outer surface 48 and the inner surface 46. The damping ring 120 thus greatly reduces the level of noise which must be tolerated by personnel working with the printing unit 10.

In the preferred embodiment, the sleeve 42 has an end portion 122 which is located axially outward of the end of the blanket cylinder 14 when the blanket 20 is installed on the blanket cylinder 14, as shown in FIG. 5. The damping ring 120 is fixed to the inner surface 46 at a position adjoining the outer edge 124 of the end portion 122. The damping ring 120 then makes the sleeve 42 easier to handle at the edge 124. Additionally, the centrifugal force acting on the damping ring 120 when the blanket 20 rotates with the blanket cylinder 14 will tend to hold the damping ring 120 in place on the inner surface 46 of the sleeve 42. The damping ring 120 could be located on the outer surface of the sleeve 42 as shown in dashed lines in FIG. 5, but the centrifugal force would urge it to separate from the sleeve 42 when the blanket 20 rotates. The damping ring 120 would then have to be more rigidly fixed to the sleeve 42. Additional damping rings or other noise attenuators could also be used as needed to suppress noise, with their material, size and location being selected accordingly. For example, the opposite end of the blanket 20 could also be constructed as shown in FIG. 5, with one or more damping rings being mounted on the outer surface of the respective end portion of the sleeve 42.

Most preferably, the damping ring 120 is formed as a flexible strip of resinous and/or other damping material with a length equal to the circumference of the inner surface 46, and is fixed to the inner surface 46 permanently by an adhesive. In the preferred embodiment of the invention shown in the drawings, the damping ring 120 is such a strip of damping material with an adhesive backing, and is marketed by Sound Seal, a division of United Process, Inc., with the trademark "ANTIPHON LD-13."

From the above description of the invention, those skilled in the art will perceive improvements, changes and modifications. Such improvements, changes and modifications within the skill of the art are intended to be covered by the appended claims.

Having described the invention, the following is claimed:

1. A tubular printing blanket (20) for mounting on a blanket cylinder (14) in an offset printing unit (10), the blanket cylinder (14) having at least one air flow opening (108) for directing a pressurized flow of air over the blanket cylinder (140, said tubular printing blanket (20) comprising:

a cylindrical printing portion (40) having an outer printing surface (44);

a cylindrical sleeve (42) supporting said printing portion (40), said sleeve (42) being movable telescopically over the blanket cylinder (14), said sleeve (42) having an initial condition with an inside diameter less than the diameter of the blanket cylinder (14) and having an expanded condition with an inside diameter greater than the diameter of the blanket cylinder (14), said sleeve (42) being expandable to said expanded condition under the influence of the pressurized flow of air over the blanket cylinder (14) when said sleeve (42) is located over the air flow opening (108) in the blanket cylinder (14); and means (120) for attenuating noise upon expansion of said sleeve (42) under the influence of the pressurized flow of air, said noise attenuating means (120) damping vibrations of said sleeve (42) which are caused by the pressurized flow of air acting on said sleeve (42), said noise attenuating means (120) being supported on said sleeve (42) to move with said sleeve (42) relative to the blanket cylinder (14) when said sleeve (42) is moved telescopically over the blanket cylinder (14).

2. A tubular printing blanket (20) for mounting on a blanket cylinder (14) in an offset printing unit (10), the blanket cylinder (14) having at least one air flow opening (108) for directing a pressurized flow of air over the blanket cylinder (14), said tubular printing blanket (20) comprising:

a cylindrical printing portion (40) having an outer printing surface (44);

a cylindrical sleeve (42) supporting said printing portion (40), said sleeve (42) being movable telescopically over the blanket cylinder (14), said sleeve (42) having an initial condition with an inside diameter less than the diameter of the blanket cylinder (14) and having an expanded condition with an inside diameter greater than the diameter of the blanket cylinder (14), said sleeve (42) being expandable to said expanded condition under the influence of the pressurized flow of air over the blanket cylinder (14) when said sleeve (42) is located over the air flow opening (108) in the blanket cylinder (14); and means (120) for attenuating noise upon expansion of said sleeve (42) under the influence of the pressurized flow of air, said noise attenuating means (120) damping vibrations of said sleeve (42) which are caused by the pressurized flow of air acting on said sleeve (42), said noise attenuating means (120) comprising a damping ring (120) extending circumferentially around said sleeve (42).

3. A tubular printing blanket (20) as defined in claim 2 wherein said damping ring (120) is supported on said sleeve (42) to move with said sleeve (42) relative to the blanket cylinder (14) when said sleeve (42) is moved telescopically over the blanket cylinder (14).

4. A tubular printing blanket (20) as defined in claim 3 wherein said sleeve (42) has an end portion (122) extending axially beyond said printing portion (40), said damping ring (120) being located inside said end portion (122) of said sleeve (42).

5. A tubular printing blanket (20) as defined in claim 3 wherein said sleeve (42) has an end portion (122) extending axially beyond said printing portion (40), said damping ring (120) being permanently fixed to the outer surface of said end portion (122).

6. A tubular printing blanket (20) as defined in claim 3 wherein said noise attenuating means (120) comprises a plurality of damping rings (120) extending circumferentially around said sleeve (42).

7. An offset printing apparatus (10) comprising:

a blanket cylinder (14) having an outer surface (48) and means (108, 112) for directing a pressurized flow of air over said outer surface (48);

a tubular printing blanket (20) having a cylindrical printing portion (40) and a cylindrical sleeve (42)

supporting said printing portion (40), said sleeve (42) being movable telescopically over said blanket cylinder (14);

said sleeve (42) having an initial condition with an inside diameter less than the diameter of said blanket cylinder (14) and having an expanded condition with an inside diameter greater than the diameter of said blanket cylinder (14), said sleeve (42) being expandable to said expanded condition under the influence of said pressurized flow of air when said sleeve (42) is located over said blanket cylinder (14); and said tubular printing blanket (20) further having means (120) for attenuating noise upon expansion of said sleeve (42) under the influence of said pressurized flow of air, said noise attenuating means (120) damping vibrations of said sleeve which are caused by said pressurized flow of air acting on said sleeve (42), said noise attenuating means 9120) comprising a damping ring (120) extending circumferentially around the inside of said sleeve (42).

8. An offset printing apparatus (10) as defined in claim 7 wherein said damping ring (200) is supported on said sleeve (42) to move with said sleeve (42) relative to said blanket cylinder (14) when said sleeve (42) is moved telescopically over said blanket cylinder (14).

9. An apparatus (10) as defined in claim 8 wherein said damping ring (120) is mounted permanently on said sleeve (42).

10. An apparatus (10) as defined in claim 9 wherein said tubular printing blanket (20) has an installed position on said blanket cylinder (14), said sleeve (42) having an end portion (122) spaced axially from said outer surface (48) of said blanket cylinder (14) when said tubular printing blanket (20) is in said installed position, said damping ring (120) being located on said end portion (122) of said sleeve (42).

* * * * *

UNITED STATES PATENT AND TRADEMARK OFFICE

CERTIFICATE OF CORRECTION

PATENT NO. : 5,215,013

DATED : June 1, 1993

INVENTOR(S) : James B. Vrotacoe and Charles D. Lyman

It is certified that error appears in the above-indentified patent and that said Letters Patent is hereby corrected as shown below:

Column 5, line 58, change "(140" to -- (14) --.

Column 7, line 19, change "9120)" to -- (120) --.

Signed and Sealed this

First Day of February, 1994

Bruce Lehman

*Attest:*

BRUCE LEHMAN

*Attesting Officer*

*Commissioner of Patents and Trademarks*